US005647525A

United States Patent [19]

Ishizawa

[11] Patent Number: 5,647,525

[45] Date of Patent: Jul. 15, 1997

[54] DRIVER BLADE FOR A PERCUSSION TOOL

[75] Inventor: Yoshinori Ishizawa, Hitachinaka, Japan

[73] Assignee: Hitachi Koki Co., Ltd., Tokyo, Japan

[21] Appl. No.: 529,214

[22] Filed: Sep. 15, 1995

[30] Foreign Application Priority Data

Oct. 14, 1994 [JP] Japan ..... 6-249423

[51] Int. Cl.[6] ..... B25C 1/04

[52] U.S. Cl. ..... 227/113; 227/119; 227/130

[58] Field of Search ..... 227/113, 119, 227/130

[56] References Cited

U.S. PATENT DOCUMENTS

| | | | |
|---|---|---|---|
| 4,341,336 | 7/1982 | Smith | 227/130 |
| 4,370,093 | 1/1983 | Lund | 227/113 |
| 4,573,623 | 3/1986 | Sexton, Jr. et al. | 227/130 |
| 4,867,366 | 9/1989 | Kleinholz | 227/130 |
| 5,231,750 | 8/1993 | Fealey | 227/130 |
| 5,495,973 | 3/1996 | Ishizawa et al. | 227/113 |

FOREIGN PATENT DOCUMENTS 65092 2/1994 Japan .

*Primary Examiner*—Scott A. Smith

*Attorney, Agent, or Firm*—Pollock, Vande Sande & Priddy

[57] ABSTRACT

A percussion tool comprises a cylinder 6 provided in a percussion tool body 1, and a piston 8 accommodated in the cylinder 6 and slidable in an axial direction of the cylinder pressure of pressurized air. A nail guide 10, provided at a front end of the percussion tool body 1, is formed into a hollow cylindrical shape capable of loading a nail 12 therein. A retaining region 15 is formed on an inner wall of the nail guide 10. A permanent magnet 19 is disposed in the retaining region 15 for magnetically holding a shaft of the nail 12 loaded in the nail guide 10. A stepdown region 14 is formed on the inner wall of the nail guide 10 inwardly than the retaining region 15 in an axial direction of the nail guide 10, so that the loaded nail 12 is aligned in parallel with a nail hitting direction. A slant surface 16 smoothly connects the stepdown region 4 to the retaining region 15. A driver blade 7, extending in the same direction as the nail hitting direction, has a base end connected to the piston 8 and a distal end acting as a hitting face 17 for hitting a head of the nail 12. A round surface is formed on a peripheral end of the hitting face 17, thereby permitting the driver blade 7 going out of a recessed portion 18, when the recessed portion. 18 is formed on the head of nail 12 during a hitting operation, without being locked in or engaged with the recessed portion 18.

11 Claims, 7 Drawing Sheets

DRIVER BLADE FOR A PERCUSSION TOOL

BACKGROUND OF THE INVENTION

1. Field of the Invention

This invention relates to a percussion tool utilized for hitting a nail into a wood or the like material, equipped with a nail guide loading a nail, for example used in construction sites, to be hit by a driver blade equipped in a front end of the percussion tool.

2. Prior Art

FIGS. 5 and 6 schematically show a conventional percussion tool disclosed in the United States patent application No. 08/191,920, or in the Taiwanese utility model application No. 83202193, assigned to the same applicant as this application. The Japanese Utility model No. 6-5092 discloses the similar structure. As shown in FIGS. 5 and 6, the percussion tool has a nail guide 10 equipped at the front end thereof. The nail guide 10, having a hollow cylindrical body guiding the shaft portion of a nail 12, is provided with. a permanent magnet 19 attached at the lower end thereof for magnetically attracting or holding the shaft portion of the nail 12 at a retaining region 15 in the nail guide 10. Thus, the user can easily handle the percussion tool by a single hand because the nail 12 is magnetically retained in the injection portion of the percussion tool body 1, thereby providing handiness in a hitting operation of the nail 12 onto a wood 13 or the like material.

In the inner cylindrical wall of the nail guide 10, there is provided a stepdown region 14. Providing such a stepdown region 14 makes it possible to support or align the nail 12 in parallel with its hitting direction (i.e. an axial direction of a driver blade 7), when the nail 12 is inserted in the nail guide 10, because a larger-diameter head of the nail 12 is positioned in the stepdown region 14 while a smaller-diameter shaft of the nail 12 is held at the retaining region 15, i.e. a non-stepdown region, by the magnetic force of the permanent magnet 19. Furthermore, there is provided a slant surface 16 between the stepdown region 14 and the retaining region 15 so as to smoothly connect the stepdown region 14 to the retaining region 15, thereby guiding the inserted nail 12 somewhat obliquely along the slant surface 18 when the nail head is hit by a hitting face 17 of the distal end of the driver blade 7. In the drawings, reference numeral 9 represents a push lever, reference numeral 11 represents a blade guide, and reference numeral 90 represents a nail sensing portion.

In the beginning of a hitting or hammering operation of the above-described percussion tool, the nail 12 is magnetically held in the nail guide 10 and is laterally offset from the center of the driver blade 7, as shown in FIG. 5. When the driver blade 7 hits or hammers the nail 12, a hammering resistance force F1 acts against the nail 12 so excessively that the nail head is deformed by the hitting face 17 of the driver blade 7 causing a recessed portion 18 thereon.

When the nail 12 is forcibly advanced downward against this hammering resistance force F1 under the condition that the driver blade 7 is engaged with or locked into the recessed portion 18 of the nail head, the driver blade 7 is subjected to a strong deflection at the distal end thereof because it is bent by a significant amount of bending force F2 which is caused by the oblique advancement of the nail 12 guided by the slant surface 16. Thus, the significant amount bending force F2 acts against the driver blade 7 in the direction normal to the nail hitting direction, i.e. the axial direction of the driver blade 7.

SUMMARY OF THE INVENTION

Accordingly, in view of the above-described problems encountered in the prior art, a principal object of the present invention is to provide a driver blade for a percussion tool capable of providing excellent durability and stability.

In order to accomplish this and other related objects, a first aspect of the present invention provides a driver blade used in a percussion tool, the percussion tool comprising a cylinder provided in a percussion tool body, A piston is accommodated in the cylinder and slidable in an axial direction of the cylinder so as to cause a reciprocative movement when receiving a pressure of pressurized air. A driver blade driven by the piston hits a nail. A nail guide is provided at a front end of the percussion tool body and is formed into a hollow cylindrical shape capable of loading the nail therein, and a retaining region is formed on an inner wall of the nail guide. Also a permanent magnet is disposed in the retaining region for magnetically holding a shaft of the nail loaded in the nail guide. A stepdown region is formed on the inner wall of the nail guide inwardly of the retaining region in an axial direction of the nail guide, so that the loaded nail is aligned in parallel with an axial direction of the driver blade. A slant surface smoothly connects the stepdown region to the retaining region.

The driver blade has a base end connected to the piston and a distal end acting as a hitting face for hitting a head of the nail; and a round surface is formed on a periphery of the hitting face, permitting the driver blade to exit a recessed portion, when the recessed portion is formed on the head of the nail during a hitting operation, to avoid being locked in or engaged with the recessed portion.

In the above driver blade, it is preferable that the round surface of the hitting face has a curvature whose radius is larger than 1.8 times of a depth of the recessed portion to be formed on the head of nail.

Furthermore, it will be desirable that the round surface of the hitting face has a sector angle equal to an approximately 90° or smaller than 90°.

Alternatively, it will be also preferable that the round surface of the hitting face is constituted by a combination of two different round surfaces arranged in a two-layer construction.

Moreover, a second aspect of the present invention provides a percussion tool comprising a cylinder provided in a percussion tool body. A piston is accommodated in the cylinder and slidable in an axial direction of the cylinder so as to cause a reciprocative movement when pressurized air is received. A nail guide is provided at a front end of the percussion tool body, the nail guide being formed into a hollow cylindrical shape capable of loading a nail therein. A retaining region is formed on an inner wall of the nail guide having a permanent magnet disposed in the retaining region for magnetically holding a shaft of the nail loaded in the nail guide. A stepdown region is formed on the inner wall of the nail guide inwardly than the retaining region in an axial direction of the nail guide, so that the loaded nail is aligned in parallel with a nail hitting direction. A slant surface smoothly connects the stepdown region to the retaining region. A driver blade extends in the same direction as the nail hitting direction, the driver blade having a base end connected to the piston and a distal end acting as a hitting face for hitting a head of the nail. A round surface, is formed on a peripheral end of the hitting face, thereby permitting the driver blade to exit a recessed portion formed on the head of nail during a hitting operation, to avoid being locked in or engaged with the recessed portion.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
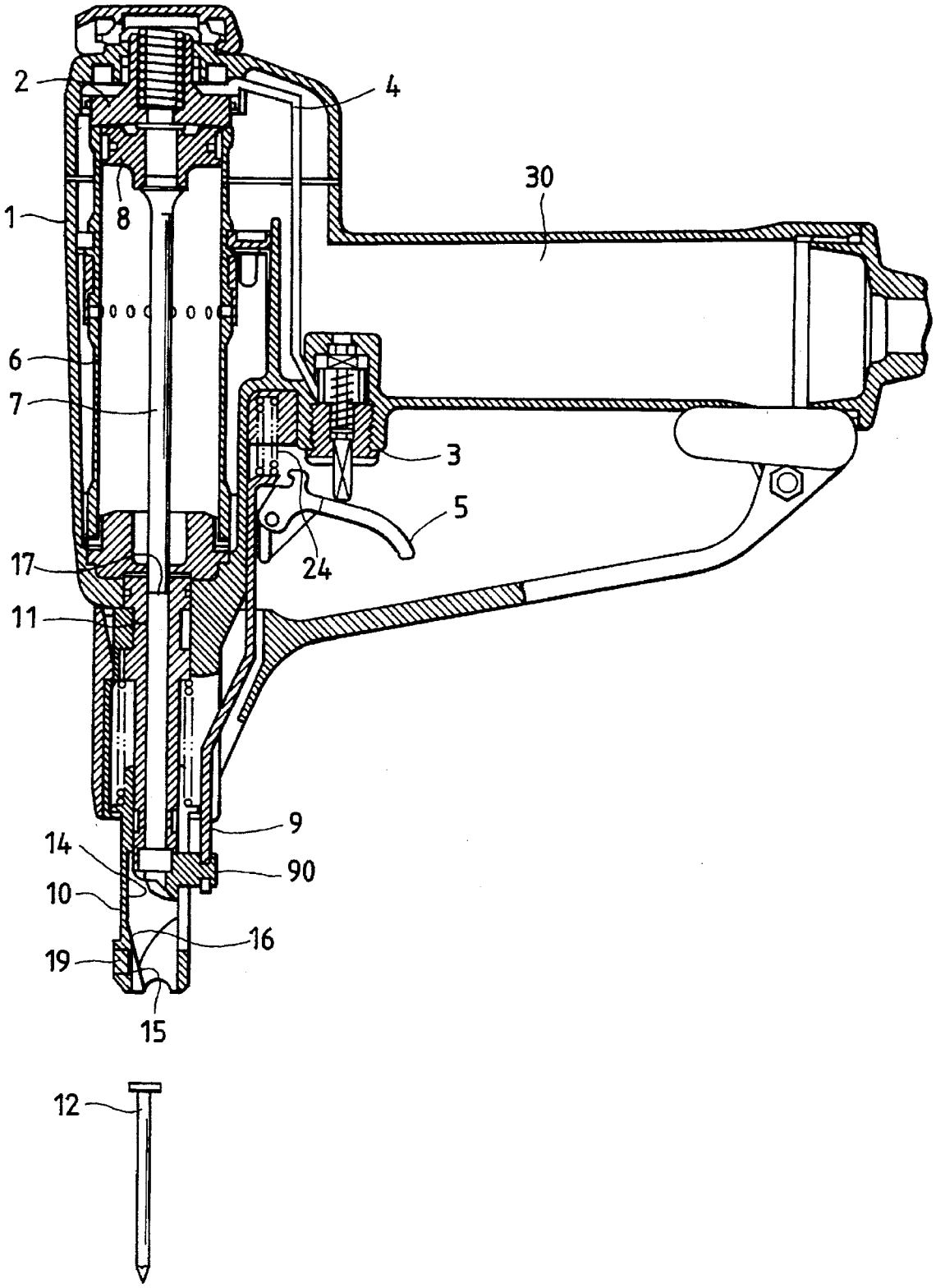
FIG. 1 is a cross-sectional side view showing an arrangement of a multi-stroke percussion tool in accordance with one embodiment of the present invention.

Preferred embodiments of the present invention will be explained in greater detail hereinafter, with reference to the accompanying drawings. Identical parts are denoted by identical reference numeral throughout views.

FIG. 1 shows an overall arrangement of a multi-stroke percussion tool in accordance with one embodiment of the present invention. A percussion tool body 1 has a pressure accumulating chamber 30 into which pressurized air is supplied from a compressor (not shown). The percussion tool body 1. comprises a trigger valve 3 which controls the opening and closing of a head valve 2, an air passage 4 communicating the trigger valve 3 to the head valve 2, a trigger lever 5 which opens or closes the trigger valve 3, and a piston 8 accommodated in a cylinder 6 so as to be slidable in an up-and-down direction (an axial direction of the cylinder 6) and integrally connected to a base end of a driver blade 7 extending in an axial direction of the cylinder 6.

An injection portion of the percussion tool attached to the lower part of the percussion tool body 1, accommodating the driver blade 7 therein, further comprises a nail sensing portion 90, a blade guide 11 having a cylindrical body with an injection hole centrally extending therein into which the driver blade 7 is slidably coupled, a nail guide 10 supported around an outer peripheral surface of the blade guide 11 so as to be slidable in the axial (i.e. up-and-down) direction for guiding a loaded nail 12, and a push lever 9 having a lower end secured to the nail sensing portion 90 and an upper end selectively engageable with the trigger lever 5. The push lever 9 is resiliently pressed downward by means of a spring 24, so as to lock the trigger lever 5 in an inoperable condition. The nail sensing portion 90 is responsive to the presence of nail 12; namely, the nail sensing portion 90 is pressed upward by the head of the nail 12 when the nail 12 is loaded in the nail guide 10 and pressed against a wood 13 or the like material. The push lever 9, integral with the nail sensing portion 90, is lifted upward and disengaged from the trigger lever 5, thereby allowing the user to operate the trigger lever 5.

The nail guide 10, having a hollow cylindrical body for guiding the shaft portion of the nail 12, is provided with a permanent magnet 19 attached at the front (lower) end thereof for magnetically attracting or holding the nail 12 at a retaining region 15 in the nail guide 10. Thus, the user can hold the percussion tool body 1 together with the nail 12 magnetically retained in the injection portion thereof without using both hands, i.e. by a single hand, providing handiness in the hitting operation of the nail 12 into the wood 13 or the like material.

Figure 2:
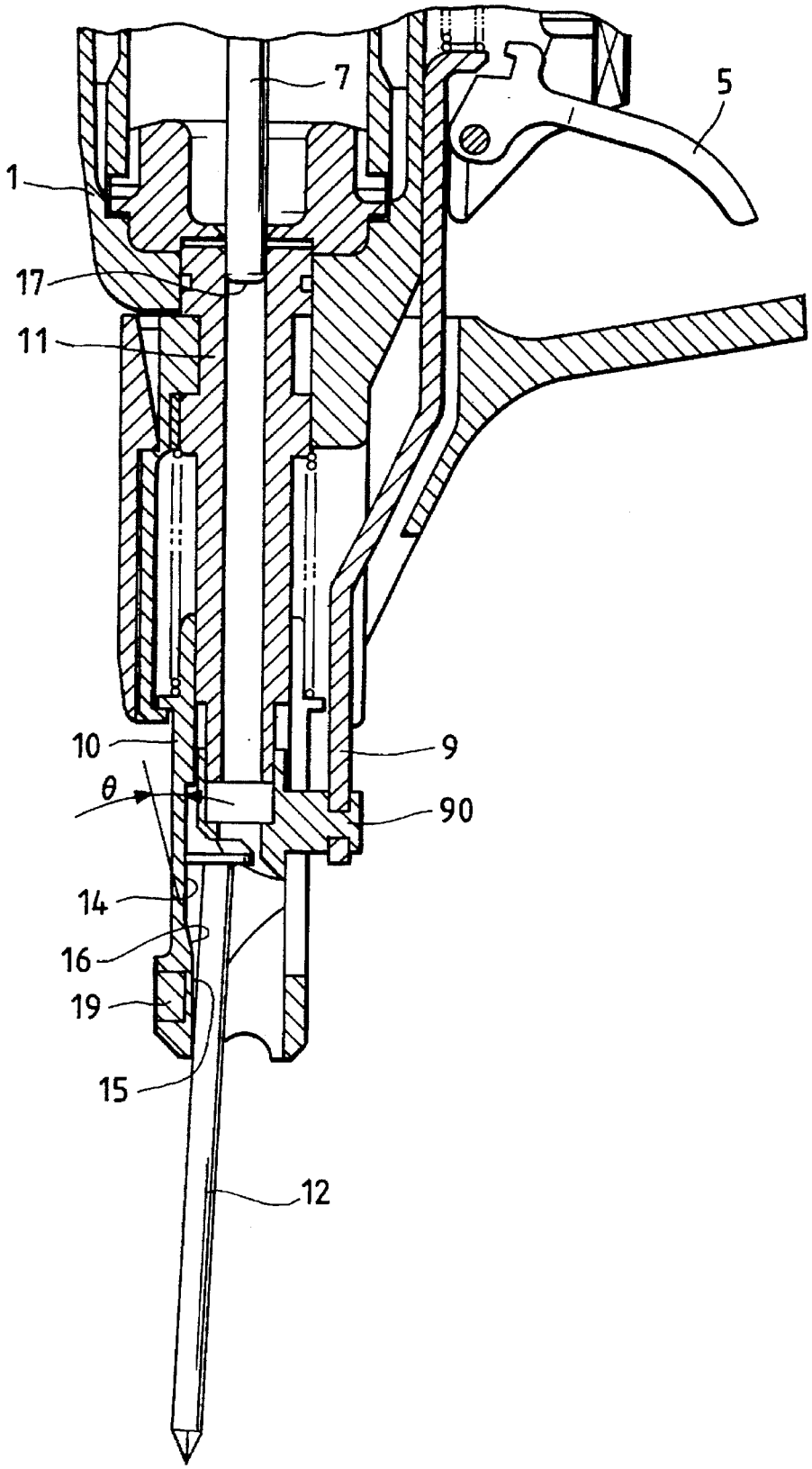
FIG. 2 is a cross-sectional view enlargedly showing a front part of the above multi-stroke percussion tool with a nail guide loading a nail thereof.

In the inner cylindrical wall of the nail guide 10, stepdown region 14 is provided inwardly (upwardly) of the retaining region 15 in an axial direction of the nail guide 10 and outwardly of the retaining region 15 in a radial direction of the nail guide 10, as shown in FIG. 2. Providing such a stepdown region 14 makes it possible to support or align the nail 12 in parallel with its hitting direction (i.e. the axial direction of the driver blade 7), when the nail 12 is loaded in the nail guide 10, because a larger-diameter head of the nail 12 is positioned in the stepdown region 14 while a smaller-diameter shaft of the nail 12 is held at the retaining region 15, i.e. a non-stepdown region, by the permanent magnet 19. There is provided a slant surface 16 between the stepdown region 14 and the retaining region 15 so as to smoothly connect the stepdown region 14 to the retaininig region 15. A hitting face 17 provided on the distal end of the driver blade 7 has a round peripheral surface with a radius 0.5 mm in the cross section thereof.

A hitting or hammering operation of the above-described multi-stroke percussion tool will be explained with reference to FIGS. 1 through 3. First of all, as shown in FIG. 2, the nail 12 is loaded into the nail guide 10 so that the shaft of the nail 12 is magnetically attracted or held by the permanent magnet 19 provided in the retaining region 15. When the front (lower) edge of the nail 12 is pressed onto the wood 13, the push lever 9 is lifted up together with the nail sensing portion 90 by the head of nail 12. Thus, the upper end of the push lever 9 is disengaged from the trigger lever 5, thereby releasing the lock condition of the trigger lever 5.

Such an unlock condition of the trigger lever 5 allows a user to freely operate (pull) the trigger lever 5 so that the pressurized air stored in the upper space above the head valve 2 is discharged or drained through the air passage 4. More specifically, when the trigger lever 5 is pulled, the trigger valve 3 is opened, and pressurized air stored in the upper space of the head valve 2 is guided to the opening of trigger valve 3 through the air passage 4 and then leaks out of the trigger valve 3. Hence, the head valve 2 is raised upward so as to open the upper end of the cylinder 6. Upon opening the head valve 2, the pressurized air rushes into the cylinder 6 from the pressure accumulating chamber 30, pressuring the piston 8. Thus, the driver blade 7 integral with the piston 8 moves downward quickly, hammering the nail 12 into the wood 13.

In this case, the nail 12 is subjected to an excessive hammering resistance force F1 acting from the wood 13. This hammering resistance force F1 is so large that the head of the nail 12 is deformed. In general, the nail 12 is made of a material softer than that of the driver blade 7. Thus, the head of the nail 12 is possibly deformed when it is strongly brought into contact or collides with the hitting face 17 of the driver blade 7 under such an excessive pressing force F1, causing a recessed portion 18 thereon having a depth in a range of 0.05 mm through 0.12 mm, as shown in FIGS. 3 and 4.

When the driver blade 7 hits the nail 12 into the used 13 against the hammering resistance force F1, the head of the nail 12 is guided by the slant surface 16. Due to inclination of the slant surface 16, the nail 12 moves somewhat obliquely with respect to the nail hitting direction (i.e. the axial direction of the driver blade 7), causing a slight shift movement in a direction normal to the nail hitting direction. In this nail hitting operation, if the hitting face 17 is securely engaged with or locked into the recessed portion 18 formed on the head of nail 12, a significant amount of bending force F2 will act on the driver blade 7 so as to deflect the distal (front or lower) end of the driver blade 7 in a direction perpendicular to the nail hitting direction.

However, the hitting face 17 has an outer peripheral portion formed into a round surface having a radius 0.5 mm in the cross section thereof. The contact angle between the round peripheral surface of the hitting face 17 and the recessed portion 18 is calculated as being approximately 34° with respect to the hitting direction, referring to the later described formula.

$$\begin{aligned}\theta_1 &= \cos^{-1}(1-L/r)\\ &= \cos^{-1}\{1-(0.05+0.12)/(2*0.5)\}\\ &= 33.9 \approx 34\end{aligned}$$

This contact angle 34° is moderate enough to allow the round peripheral surface of the hitting face 17 to escape from the recessed portion 18 by overcoming the depth of the recessed portion 18. Hence, the driver blade 7 is always kept aligned along the nail hitting direction, assuring the precise hammering operation of the nail 12 when it is driven by the piston 8.

On the other hand, when the trigger lever 5 is released, the trigger valve 3 is returned to its closing position so as to close its opening. Thus, the air passage 4 is connected to the pressure accumulating chamber 30. The head valve 2 is lowered by the pressurized air introduced into the upper space of the head valve 2, closing the upper end of the cylinder 6 as shown in FIG. 1. After that, the pressurized air stored outside the cylinder 6 is introduced into a lower space of the cylinder 6 defined beneath the piston 8. Receiving the pressure of the thus introduced air, the piston 8 and the driver blade 7 are returned together to the predetermined top dead center of its reciprocative movement, thus completing one cycle of the hammering operation of hitting the nail 12.

Figure 3:
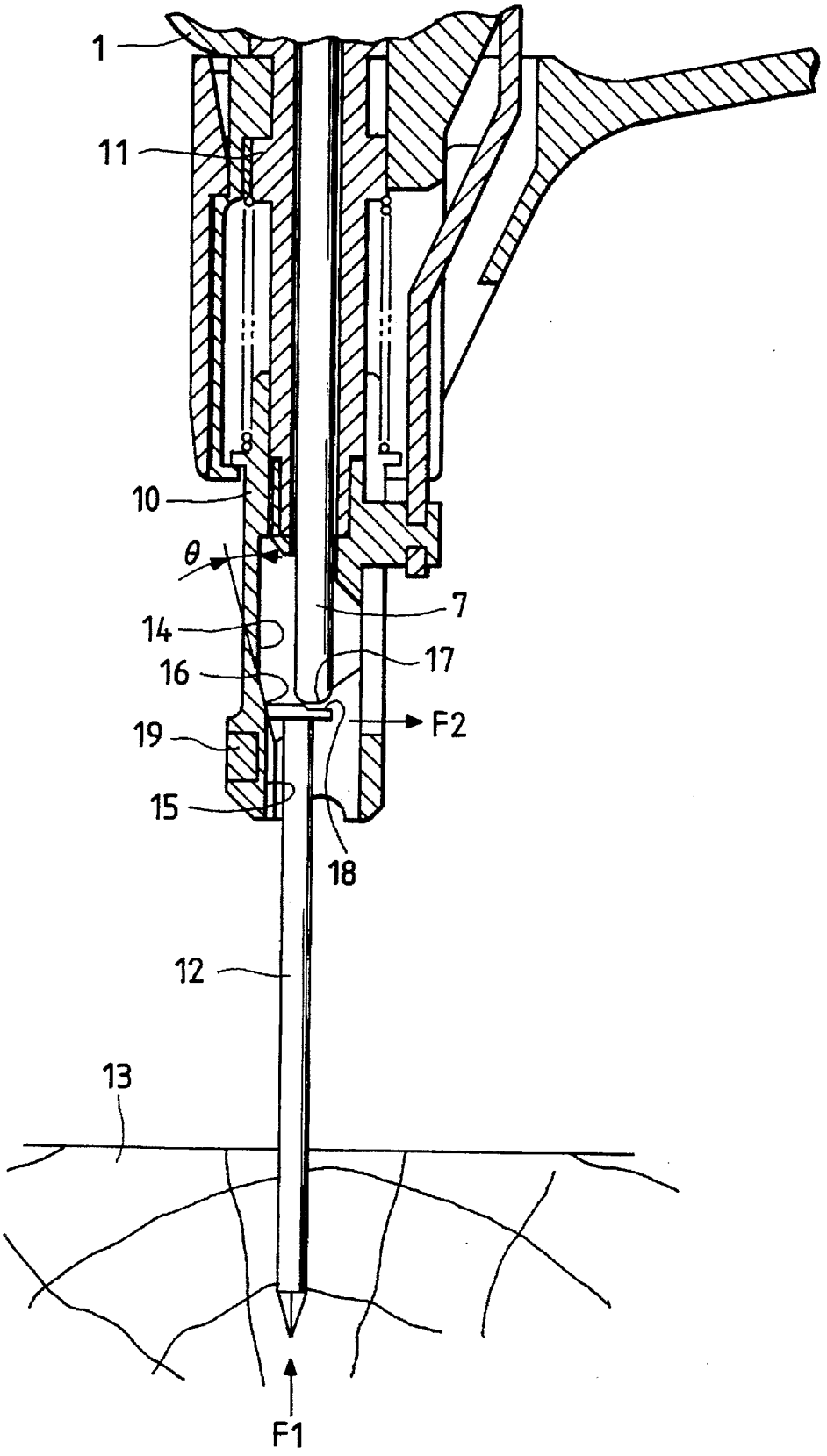
FIG. 3 is a cross-sectional side view showing one operational condition of the percussion tool in accordance with the embodiment of the present invention, wherein the nail is partly hit into a wood.
Figure 4:
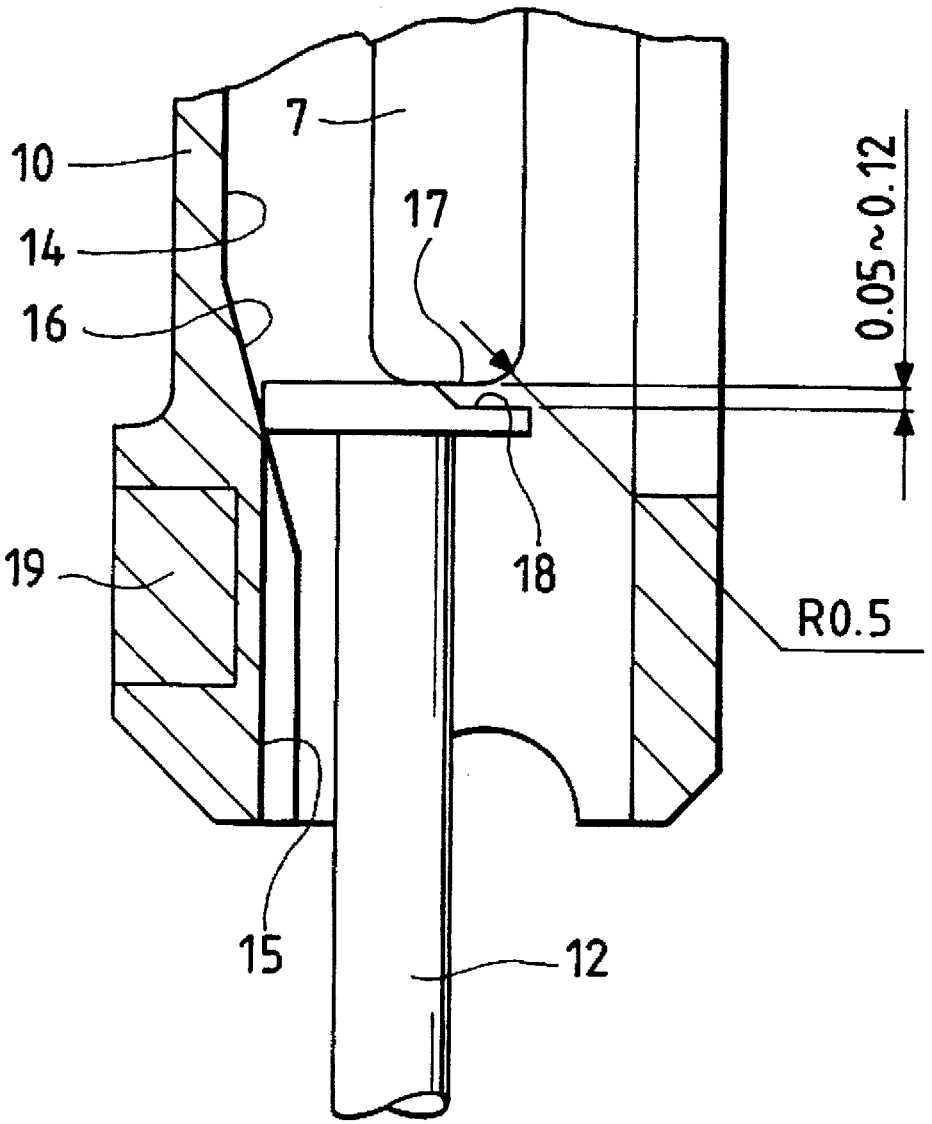
FIG. 4 is a cross-sectional side view enlargedly showing the engagement of the nail and a driver blade in the operational condition of the percussion tool in accordance with the embodiment of the present invention.
Figure 5:
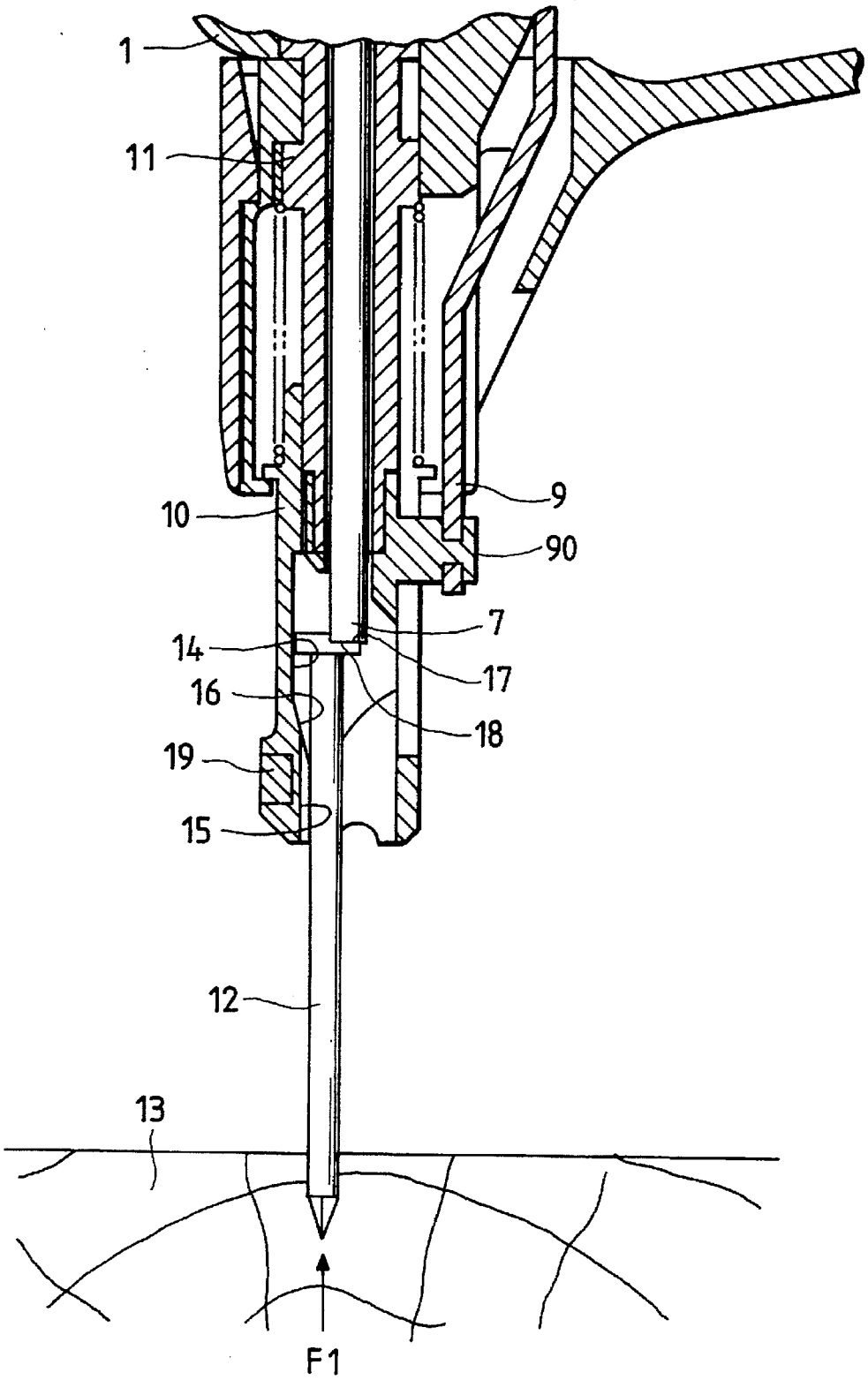
FIG. 5 PRIOR ART
FIG. 5 is a cross-sectional view showing a front part of the arrangement of a conventional multi-stroke percussion tool, wherein a nail is partly hit into a wood.
Figure 6:
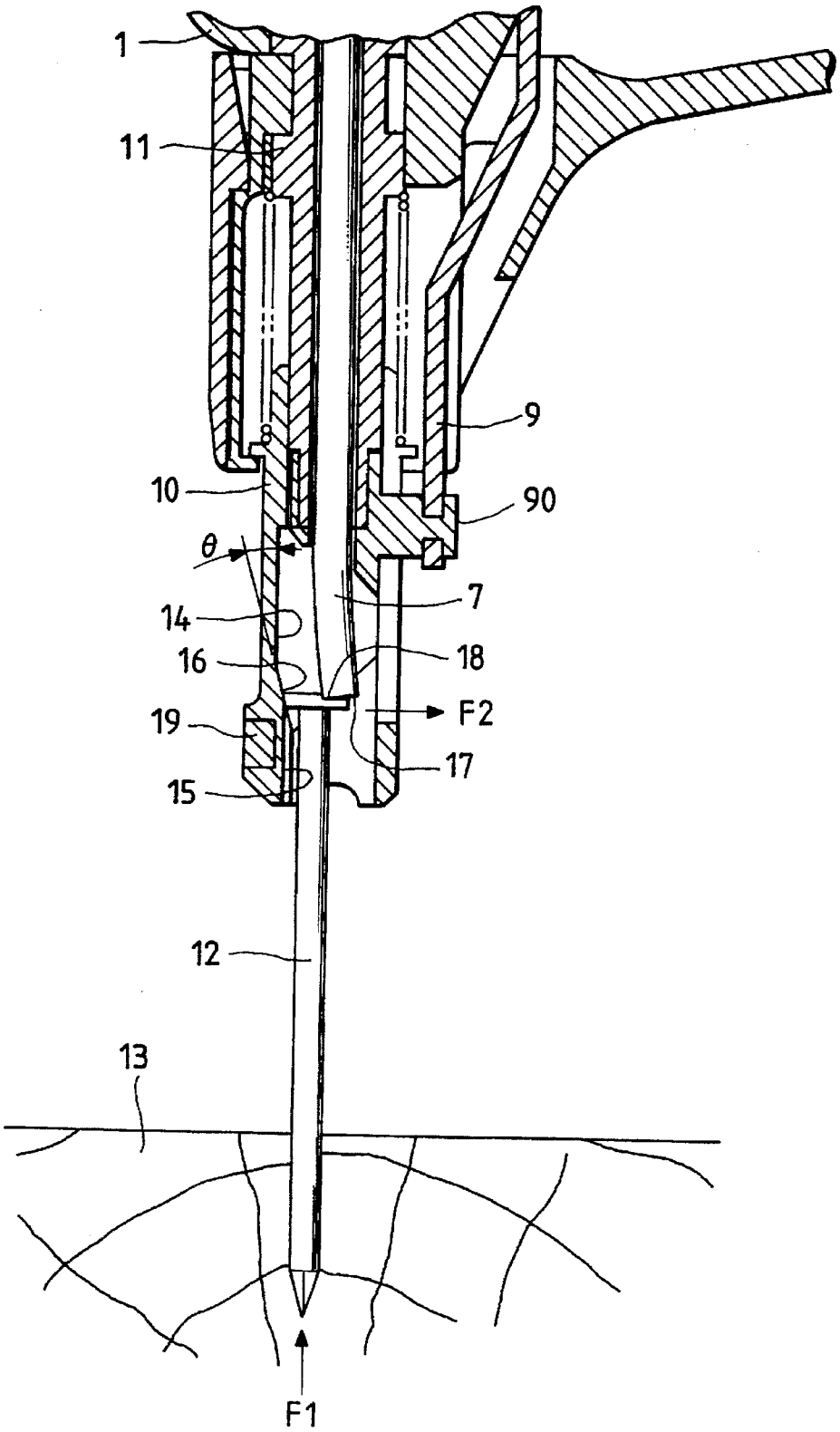
FIG. 6 PRIOR ART
FIG. 6 is a cross-sectional view showing the front part of the arrangement of the above conventional multi-stroke percussion tool, wherein the nail is so deeply hit into the wood that the driver blade causes deflection at its distal end.

At this moment, the nail 12 in the nail guide 10 is in a condition where approximately ⅓ of its entire length is hit into the wood 13, as shown in FIG. 3. If the percussion tool body 1 is pressed to the wood 13, the push lever 9 will again move to its raised position by being lifted by the head of the nail 12 which is counteractively pressed by the wood 13. Thus, the trigger lever 5 is placed in an unlocked state. Accordingly, by pulling the trigger lever 5 again, the next hammering operation is initiated. And, the hammering operation is repetitively performed until the head of nail 12 completely reaches the surface of the wood 13. In this manner, the percussion tool, if it has an output power sufficient to completely hit a short nail into a wood by one stroke, can be used to hammer a relatively long nail into a wood by hitting it multiple times. Using such a small and light percussion tool can increase the flexibility in performing the hammering operation in any horizontal or vertical directions.

Although the above embodiment shows a multi-stroke percussion tool, it is needless to say that the present invention can be employed in any other types of tools, such as single-stroke percussion tools, when they have a slant surface in the nail guide.

Next, the largeness of the cross-sectional radius of the round peripheral surface of the hitting face 17 of the driver blade 7 will be explained.

Figure 7:
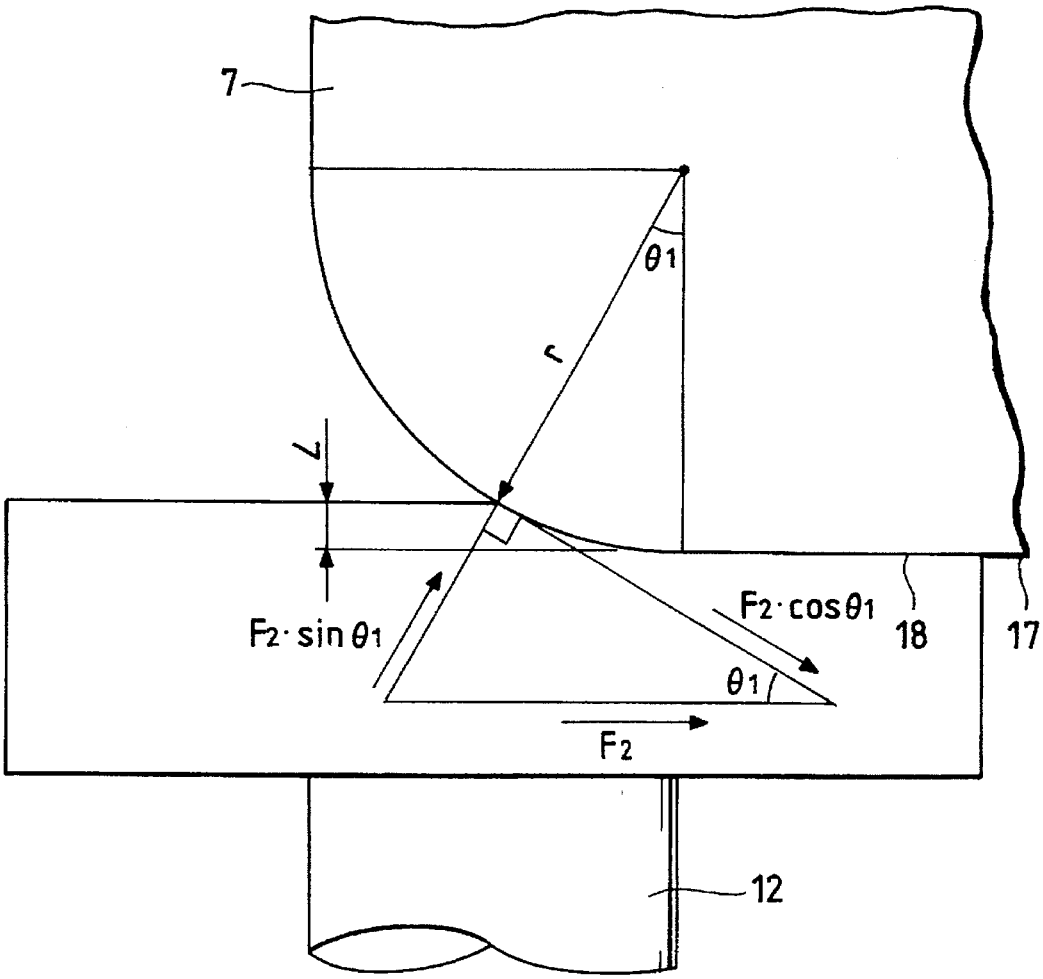
FIG. 7 is a view illustrating a principle of the driver blade escaping mechanism of the percussion mechanism in accordance with the present invention.

In FIG. 7, if a sliding force acting on the distal end of the driver blade 7 is larger than a frictional force acting between the driver blade 7 and the recessed portion 18, the driver blade 7 can escape from or the recessed portion 18. Namely, the conditions for assuring safe escaping of the driver blade 7 is given by the following formula.

$$F>\mu\cdot N$$

where "F" is the sliding force acting on the distal end of the driver blade 7, "μ" is a frictional coefficient between the driver blade 7 and the nail 12 (μ=0.52 for the driver blade 7 and the nail 12 both made of iron), and "N" is a vertical resistance force.

Accordingly, referring to resolved components of the force F2 shown in FIG 7, the following relation needs to be established:

$$F_2\cdot\cos\theta_1>0.52\,F_2\cdot\sin\theta_1$$

$$\theta_1>63°$$

Meanwhile, the relation $r=L/(1-\cos\theta_1)$ must be satisfied, where "r" is a radius of the round peripheral surface of the hitting face 17 in the cross section thereof and "L" is a depth of the recessed portion 18. Thus, when $\theta_1=63°$ is entered, $$r>L/(1-\cos 63°)$$

$$r>1.8L$$

Accordingly, as understood from the above calculation, it is preferable that the radius "r" of the curved line of the round peripheral surface of the hitting face 17 along a plane passing through the axis of the driver blade 7 is larger than 1.8 times of the depth "L" of the recessed portion 18.

Figure 8:
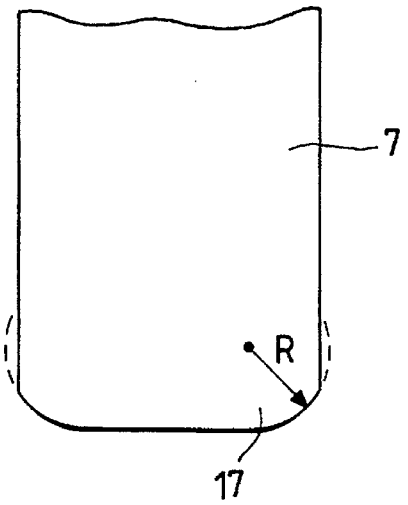
FIG. 8 is a cross-sectional view showing another embodiment of a round peripheral surface of the driver blade in accordance with the present invention.

FIG. 8 shows another embodiment of the driver blade 7 in accordance with the present invention, wherein the cross section of the round peripheral surface of the hitting face 17 along an axis of the driver blade 7 has a sector angle smaller than that (90°) of the above embodiment.

Figure 9:
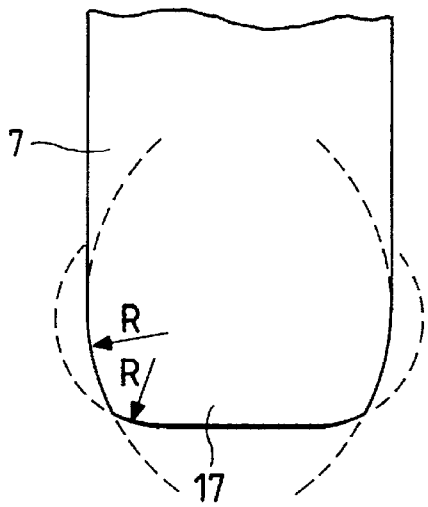
FIG. 9 is a cross-sectional view showing still another embodiment of the round peripheral surface of the driver blade in accordance with the present invention.

FIG. 9 still shows another embodiment of the driver blade 7 in accordance with the present invention, wherein the round peripheral surface of the hitting face 17 of the driver blade 7 is formed by a combination of two different round surfaces arranged in a two-layer construction.

As described above, the present embodiments surely prevent the driver blade from being locked into the recessed portion formed on the nail head, causing no deflection or damage of the driver blade. Consequently, it becomes possible to increase the durability of the driver blade and assure stable performance of the driver blade.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A driver blade used for a percussion tool, said percussion tool comprising a cylinder provided in a percussion tool body, a piston accommodated in said cylinder and slidable in an axial direction of said cylinder so as to cause a reciprocative movement when receiving pressurized air, a driver blade driven by said piston for hitting a nail, a nail guide provided at a front end of said percussion tool body and formed into a hollow cylindrical shape capable of loading the nail therein, a retaining region formed on an inner wall of said nail guide, a permanent magnet disposed in said retaining region for magnetically holding a shaft of said nail loaded in said nail guide, a stepdown region formed on said inner wall of said nail guide inward of said retaining region along an axial direction of said nail guide, so that the loaded nail is aligned parallel with an axial direction of said driver blade, and a slant surface smoothly connecting said stepdown region to said retaining region, wherein said driver blade has a base end to be connected to said piston and a distal end acting as a hitting face for hitting a head of said nail which includes a round surface having a curvature whose radius is larger than 1.8 times a depth of a recessed portion on the head of a nail and being formed on a periphery of said hitting face, thereby permitting said driver blade to exit said recessed portion, formed on the head of said nail during an initial stage of a hitting operation, without engaging said recessed portion.

2. The driver blade defined by claim 1, wherein said round surface of the hitting face has a sector angle substantially equal to 90°.

3. The driver blade defined by claim 1, wherein said round surface of the hitting face has a sector angle smaller than 90°.

4. The driver blade defined by claim 1, wherein said round surface of the hitting face includes a combination of two different round surfaces comprising a compound-surface.

5. The driver blade defined by claim 1, wherein said round surface of the hitting face has curvature whose radius is substantially 0.5 mm.

6. The driver blade defined by claim 1, wherein said depth of said recessed portion formed on the head of the nail is in a range of 0.05 through 0.12 mm.

7. The driver blade defined by claim 1, wherein curvature of said round surface of the hitting face satisfies the following relationship:

$$F>\mu \cdot N$$

where F represents a sliding force acting on the distal end of said driver blade, μ represents a frictional coefficient between said driver blade and said nail, and N represents a vertical resistance force.

8. A percussion tool comprising:

a cylinder provided in a percussion tool body;

a piston accommodated in said cylinder and slidable in an axial direction of said cylinder so as to cause a reciprocative movement when receiving pressurized air;

a nail guide provided at a front end of said percussion tool body, said nail guide being formed into a hollow cylindrical shape capable of loading a nail therein;

a retaining region formed on an inner wall of said nail guide;

a permanent magnet disposed in said retaining region for magnetically holding a shaft of said nail loaded in said nail guide;

a stepdown region formed on said inner wall of said nail guide inward of said retaining region along an axial direction of said nail guide, so that the loaded nail is aligned in parallel with a nail hitting direction;

a slant surface smoothly connecting said stepdown region to said retaining region;

a driver blade extending along said nail hitting direction, said driver blade having a base end connected to said piston and a distal end acting as a hitting face for hitting a head of said nail; and a round surface having a curvature whose radius is larger than 1.8 times a depth of a recessed portion on the head of a nail and being formed on a peripheral end of said hitting face, thereby permitting said driver blade to exit said recessed portion formed on the head of a nail during an initial stage of a hitting operation avoiding engagement with said recessed portion during a final stage of said nail hitting opperation.

9. The percussion tool defined by claim 8, wherein said round surface of the hitting face has curvature whose radius is substantially 0.5 mm.

10. The percussion tool defined by claim 8, wherein said depth of said recessed portion formed on the head of the nail is in a range of 0.05 through 0.12 min.

11. The percussion tool defined by claim 8, wherein curvature of said round face of the hitting face satisfies the following relationship:

$$F>\mu \cdot N$$

where F represents a sliding force acting on the distal end of said driver blade, μ represents a frictional coefficient between said driver blade and said nail, and N represents a vertical resistance force.

* * * * *